US009115491B2

(12) United States Patent
Keith et al.

(10) Patent No.: US 9,115,491 B2
(45) **Date of Patent: *Aug. 25, 2015**

(54) METHOD AND DEVICES FOR FRAMING OPENINGS IN CAST-IN-PLACE WALLS

(71) Applicant: Stala Integrated Assemblies, LLC, Louisville, KY (US)

(72) Inventors: John Andrew Keith, Shepherdsville, KY (US); Jonathan Paul Keith, Louisville, KY (US); James Todd Essex, Louisville, KY (US)

(73) Assignee: STALA INTEGRATED ASSEMBLIES, LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/784,038

(22) Filed: Mar. 4, 2013

(65) Prior Publication Data

US 2013/0239504 A1 Sep. 19, 2013

Related U.S. Application Data

(63) Continuation of application No. 11/946,458, filed on Nov. 28, 2007, now Pat. No. 8,407,954.

(60) Provisional application No. 60/867,611, filed on Nov. 29, 2006.

(51) Int. Cl.
*E06B 1/04* (2006.01)
*E04C 2/38* (2006.01)
(Continued)

(52) U.S. Cl.
CPC ..... *E04B 2/8652* (2013.01); *E04B 2/44* (2013.01); *E04B 2/46* (2013.01); *E06B 1/003* (2013.01); *E04B 2/7412* (2013.01); *E04B 2/8617* (2013.01)

(58) Field of Classification Search
CPC ..... E04B 2/825; E04B 2/7854; E04B 2/8617; E04B 2/58; E04B 2/78; E06B 1/02; E06B 1/12; E06B 1/52; E06B 1/6092
USPC ..... 52/831, 204.1, 213, 656.2, 204.2, 52/215–217, 210, 836
See application file for complete search history.

(56) References Cited

U.S. PATENT DOCUMENTS 1,615,972 A * 2/1927 Bowers ..... 52/255
1,704,717 A 3/1929 Baum
(Continued)

OTHER PUBLICATIONS

Novak, V., "Pushing the Energy Envelope with ICFs," Modernmaterials, Nov. 2006, pp. 12-16.
(Continued)

*Primary Examiner* — Phi A
*Assistant Examiner* — Omar Hijaz
(74) *Attorney, Agent, or Firm* — Frost Brown Todd LLC

(57) ABSTRACT

A wall assembly comprises a wall component and a framing member. The wall component comprises a first wall panel, a second wall panel, and at least one connecting member positioned between the first wall panel and the second wall panel. The framing member comprises a first panel receiving channel configured to receive at least a portion of the first wall panel, and a first inner flange comprising a first anchor portion configured to guide the first wall panel into the first panel receiving channel. Additional embodiments may include a second panel receiving channel configured to receive at least a portion of the second wall panel and a second inner flange comprising a second anchor portion configured to guide the second wall panel into the second panel receiving channel. Embodiments may be used to form walls made of cast-in-place concrete.

19 Claims, 18 Drawing Sheets

(51) Int. Cl.

| | |
|---|---|
| ***E04C 3/00*** | (2006.01) |
| ***E04B 2/86*** | (2006.01) |
| ***E06B 1/00*** | (2006.01) |
| ***E04B 2/44*** | (2006.01) |
| ***E04B 2/46*** | (2006.01) |
| *E04B 2/74* | (2006.01) |

(56) References Cited

U.S. PATENT DOCUMENTS

| | | | | | |
|---|---|---|---|---|---|
| 1,854,633 | A | | 4/1932 | Stephens | |
| 2,174,844 | A | | 10/1939 | Sedore | |
| 2,973,567 | A | * | 3/1961 | Brow, Jr. et al. | 249/207 |
| 3,460,302 | A | * | 8/1969 | Cooper | 52/242 |
| 3,568,383 | A | * | 3/1971 | Judkins et al. | 52/210 |
| 3,724,135 | A | | 4/1973 | Heliotes | |
| 3,732,657 | A | * | 5/1973 | Nelsson | 52/241 |
| 3,924,373 | A | * | 12/1975 | Lizdas et al. | 52/213 |
| 3,998,027 | A | * | 12/1976 | Wendt et al. | 52/716.1 |
| 4,034,514 | A | | 7/1977 | Cecil | |
| 4,151,691 | A | * | 5/1979 | Wendt | 52/242 |
| 4,209,953 | A | * | 7/1980 | Wendt | 52/241 |
| 4,223,494 | A | * | 9/1980 | Wendt | 52/211 |
| 4,226,066 | A | * | 10/1980 | Persson | 52/211 |
| 4,361,994 | A | * | 12/1982 | Carver | 52/238.1 |
| 4,442,644 | A | * | 4/1984 | Jukes | 52/213 |
| 4,463,531 | A | | 8/1984 | Iorio Peretto | |
| 4,513,557 | A | * | 4/1985 | Wendt | 52/489.1 |
| 4,823,534 | A | * | 4/1989 | Hebinck | 52/742.14 |
| 4,873,804 | A | | 10/1989 | Kukke | |
| 4,930,257 | A | | 6/1990 | Windgassen | |
| 5,390,459 | A | * | 2/1995 | Mensen | 52/426 |
| 5,603,191 | A | * | 2/1997 | Wu | 52/204.1 |
| 5,669,198 | A | | 9/1997 | Ruff | |
| 5,771,644 | A | * | 6/1998 | Kidd | 52/213 |
| 5,791,103 | A | | 8/1998 | Coolman et al. | |
| 5,979,129 | A | | 11/1999 | Azar | |
| 5,996,293 | A | | 12/1999 | Anderson et al. | |
| 6,070,375 | A | * | 6/2000 | Anderson et al. | 52/204.54 |
| 6,178,711 | B1 | | 1/2001 | Laird et al. | |
| 6,453,620 | B1 | | 9/2002 | Williams et al. | |
| 6,530,185 | B1 | * | 3/2003 | Scott et al. | 52/215 |
| 6,698,710 | B1 | | 3/2004 | VanderWerf | |
| 6,792,729 | B2 | | 9/2004 | Béliveau | |
| 6,837,012 | B2 | * | 1/2005 | Scherrer et al. | 52/290 |
| 6,918,218 | B2 | * | 7/2005 | Greenway | 52/267 |
| 8,407,954 | B2 | | 4/2013 | Keith et al. | |
| 2001/0001918 | A1 | * | 5/2001 | Ruff | 52/656.4 |
| 2004/0144057 | A1 | * | 7/2004 | Meek et al. | 52/656.2 |

OTHER PUBLICATIONS

U.S. Appl. No. 60/867,611, filed Nov. 29, 2006, Keith et al.

Wall_Termination_EJ101, Brick_Encapsolation schematic, by JAMB-IT-ALL, All-terior Systems LLC, Oct. 19, 2006.

* cited by examiner

METHOD AND DEVICES FOR FRAMING OPENINGS IN CAST-IN-PLACE WALLS

PRIORITY

This application is a continuation of U.S. patent application Ser. No. 11/946,458, entitled "Method and Devices for Framing Openings in Cast-In-Place Walls," filed Nov. 28, 2007, which issued as U.S. Pat. No. 8,407,954 on Apr. 2, 2013, the disclosure of which is incorporated by reference herein, and which claims the benefit of U.S. provisional patent application Ser. No. 60/867,611 entitled "Framing System for Wall Openings," filed Nov. 29, 2006, the disclosure of which is incorporated by reference herein.

FIELD OF THE INVENTION

The present invention relates to devices and methods for framing openings in building walls, and more particularly, devices and methods for framing openings for doors, windows, storefronts, air conditioner unit installations, and other purposes in walls constructed of cast-in-place concrete.

BACKGROUND

Embodiments of the present invention relate to a system that may be used to frame openings in walls. Such openings may include, but are not limited to, those for windows, doors, air conditioning units, store fronts, curtain walls, etc. In the present example, a framing system is used with an "Insulated Concrete Form" wall system provided by Nudura Corporation of Barrie, Ontario.

While the framing system of the present example will be described herein in the context of the Nudura wall system, it will be appreciated that the framing system of the present example (including variations thereof) may be used with a variety of other wall systems. Accordingly, it is contemplated that the Nudura wall system is simply one merely illustrative example of a wall system with which the framing system of the present example may be used; and that various other wall systems with which the framing system of the present example may be used will be apparent to those of ordinary skill in the art.

The Nudura wall system of the present example comprises a pair of insulating wall members and a plurality of webs or brackets positioned between the pair of insulating wall members. The brackets are configured to hold the pair of insulating wall members apart at a certain distance, and to receive and hold lengths or portions of reinforcing rods or other reinforcing members. With the wall members, brackets, and reinforcing members in place, concrete is poured in the space between the wall members, such that the wall members provide a form for the concrete. The wall members, brackets, and reinforcing members are left in place after the concrete has been poured and has cured.

It will be appreciated that certain situations may call for a window, doorway, storefront, curtain wall, or other opening to be formed in a cast concrete wall. For instance, in a Nudura wall system, it may be desirable to provide such openings before the concrete is poured. Such openings may be defined by a framing system such as the framing system of the present example. In particular, a framing system may be engaged with a Nudura wall system to define an opening, facilitate the alignment of the wall, and/or to prevent poured concrete from flowing into the opening. Furthermore, such a framing system may be left in place after the concrete has been poured, to form a framed opening ready to receive a door or a window, hardware associated therewith, or other members, structures or hardware which the opening is intended to accommodate.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

Reference will now be made in detail to various embodiments of the invention, examples of which are illustrated in the accompanying drawings. To the extent that specific dimensions are shown in the accompanying drawings, such dimensions should be regarded as merely illustrative and not limiting in any way. Accordingly, it will be appreciated that such dimensions may be varied in any suitable way.

DETAILED DESCRIPTION OF EMBODIMENTS

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 9:
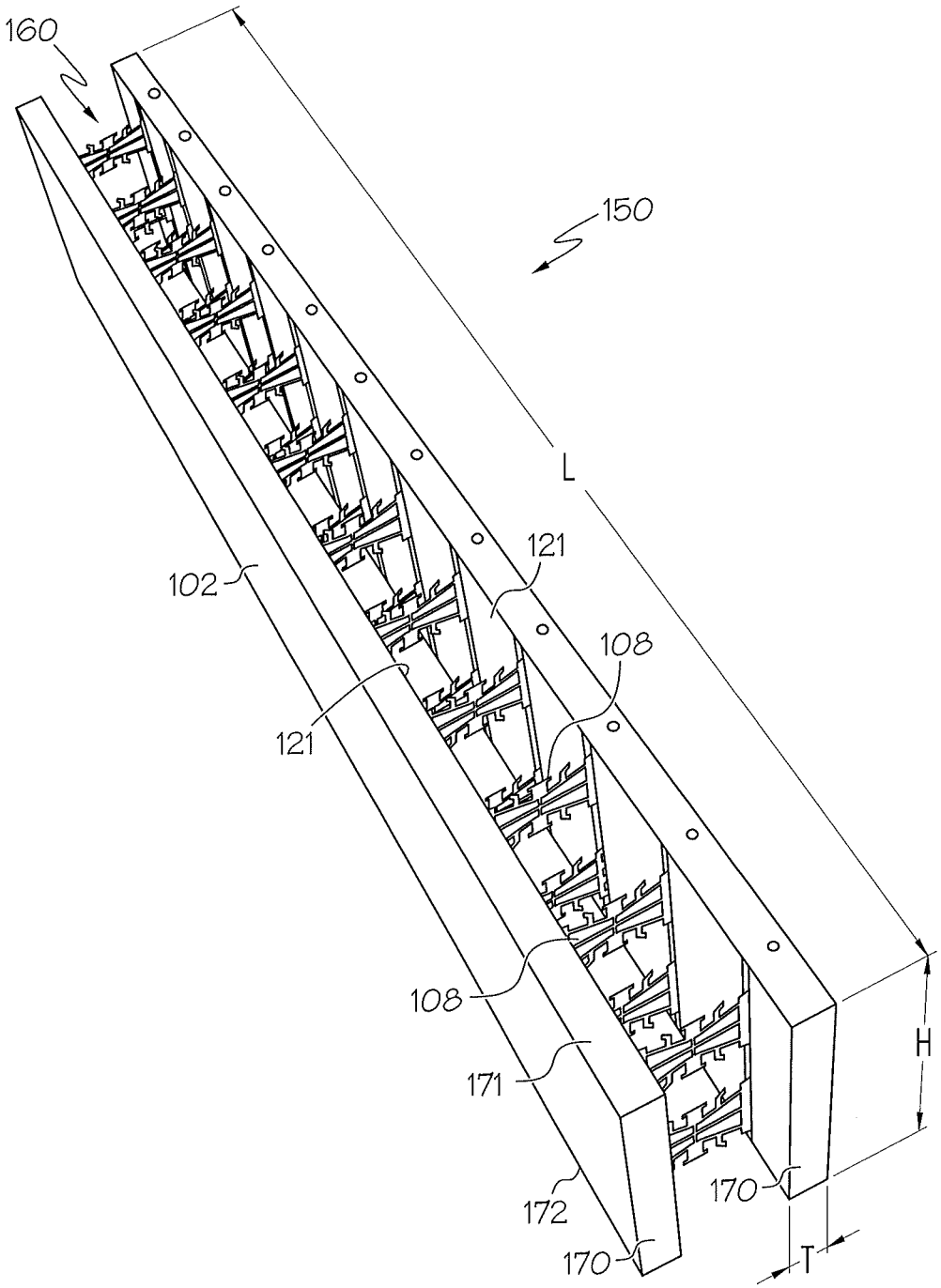
FIG. 9 is a perspective view of an example of a wall system component with which a framing system described herein may be used.

FIG. 9 depicts an example of a wall system component 150 with which the framing system described herein may be used. The component 150 may include first and second panels such as wall members 102, having length L, height H and thickness T, and having vertical edges 170. Wall members 102 may be connected by a plurality of brackets 108 or other suitable connecting members having ends attached to each of wall members 102. Brackets 108 or other suitable connecting members hold wall members 102 in a uniformly spaced-apart relationship, with inner surfaces 121 defining space 160 therebetween. Wall system components such as depicted in FIG. 9 are available from Nudura Corporation of Barrie, Ontario, in varying dimensions and specifications. A typical component 150 may have panels having height H=18", length L=96", and thickness T=2⅝", with varying widths for space 160 depending upon the overall thickness of the wall required. The top and bottom edges 171, 172 of members 102 may be formed with respectively mating features so that a plurality of components 150 may be interlockably stacked to form a section of a wall form, whereby concrete may be poured into space 160 to form a wall section having a concrete core and outer panels comprising wall members 102. Wall members 102 may be formed of, for example, expanded polystyrene, which has insulating properties. Wall members 102 also may be formed with vertical grooves along the inner surfaces 121 thereof, into which concrete may flow when poured into space 160, providing for interlocking and bonding of the concrete core with wall members 102 after the concrete hardens.

Figure 1B:
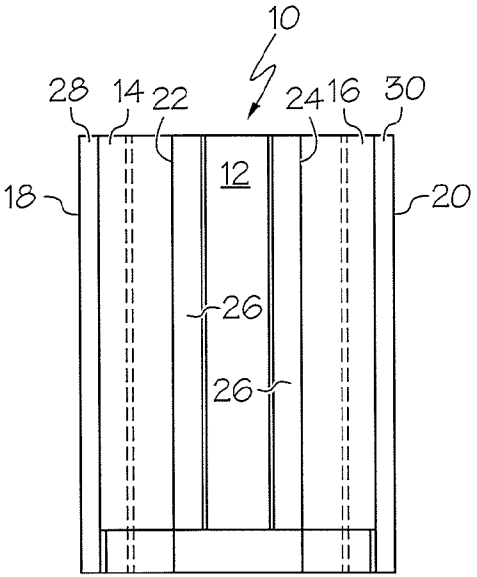
FIG. 1B depicts a plan view of the framing member of FIG. 1A.
Figure 1C:
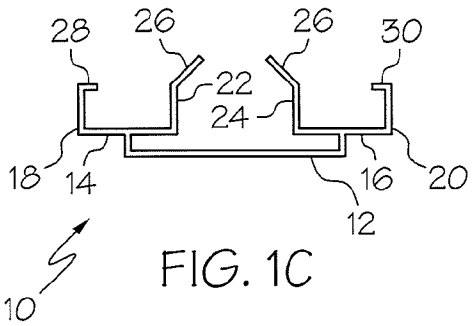
FIG. 1C depicts an end view of the framing member of FIG. 1A.
Figure 1A:
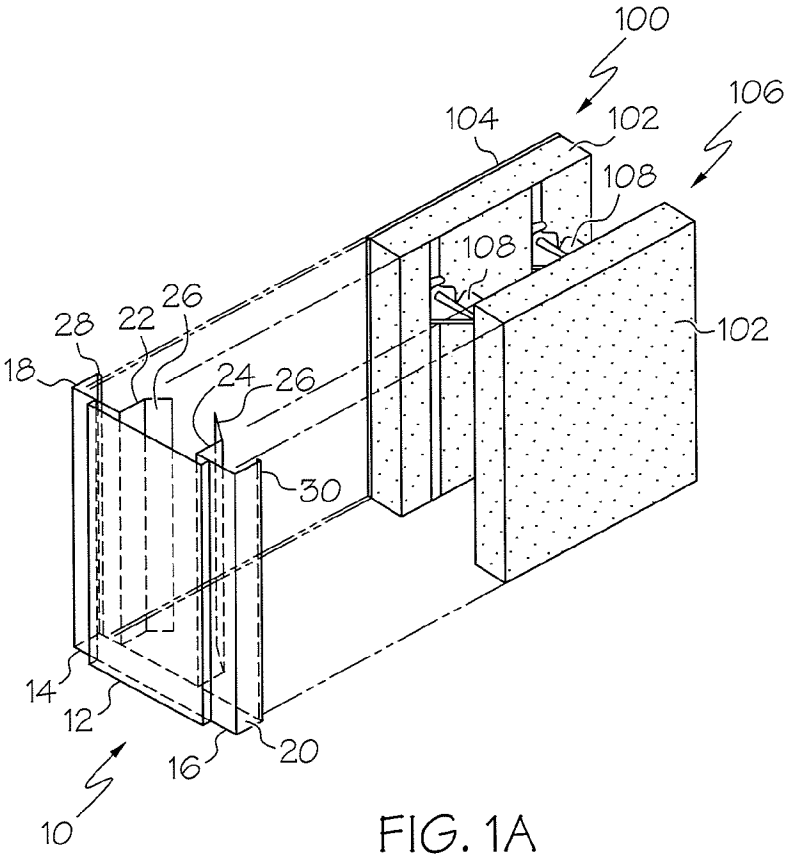
FIG. 1A depicts a perspective view of an exemplary framing member.

As shown in FIG. 1, an exemplary framing member 10 comprises a first member 12, a second member 14, a third member 16, a first outer flange 18, a second outer flange 20, a first inner flange 22, and a second inner flange 24. Each of the first inner flange 22 and second inner flange 24 has an anchor portion 26. As shown, the second member 14 and third member 16 are each joined to a respective end of the first member 12. The first outer flange 18 and first inner flange 22 extend from the second member 14; and the second outer flange 20 and second inner flange 24 extend from the third member 16. The anchor portion 26 of the first inner flange 22 is oriented at an angle of approximately 135° relative to the first inner flange 22. Similarly, the anchor portion 26 of the second inner flange 24 is oriented at an angle of approximately 135° relative to the second inner flange 24. It will be appreciated, however, that each anchor portion 26 may be oriented at any other suitable angle relative to its corresponding inner flange 22, 24. For instance, first inner flange 22 and its anchor portion 26 may form an angle anywhere between approximately 1° and approximately 90°; anywhere between approximately 90° and approximately 179°; or any other suitable angle.

In the present example, first outer flange 18 terminates in an inwardly curling portion 28. Inwardly curling portion 28 is oriented inward toward first inner flange 22, then toward second member 14. Similarly, second outer flange 20 terminates in an inwardly curling portion 30. Inwardly curling portion 30 is oriented inward toward second inner flange 24. Of course, as with any other component described herein, inwardly curling portions 28, 30 may be configured in any other suitable way, or may be omitted altogether.

As is also shown in FIG. 1, first outer flange 18 and first inner flange 22 are spaced to receive a first wall portion 100 and facilitate the alignment of the wall. In this example, first wall portion 100 comprises a wall member 102 and one or more sheets of drywall 104 positioned adjacent to the wall member 102. Similarly, second outer flange 20 and second inner flange 24 are spaced to receive a second wall portion 106, which also comprises a wall member 102. Wall members 102 are separated by brackets 108. In the present example, first wall portion 100 is provided as an interior wall for a structure; while second wall portion 106 is provided as an exterior wall for a structure. Of course, various structures or materials may be added to or near each wall portion 100, 106, including but not limited to paneling, masonry, stucco, Exterior Insulation and Finish Systems (EIFS), insulation, siding, etc.

When framing member 10 of the present example is engaged with wall portions 100, 106, the first inner flange 22 is adjacent to the inner surface of the wall member 102 of the first wall portion 100; while the inwardly curling portion 28 is adjacent to the outer surface of the drywall 104. The second inner flange 22 is adjacent to the inner surface of the wall member 102 of the second wall portion 106; while the inwardly curling portion 30 is adjacent to the outer surface of the wall member 102 of the second wall portion 106. It will be appreciated, however, that framing member 10 may engage wall portions 100, 106 in a variety of alternative ways. It will also be appreciated that framing member 10 may engage a variety of other types of wall members.

Figure 2:
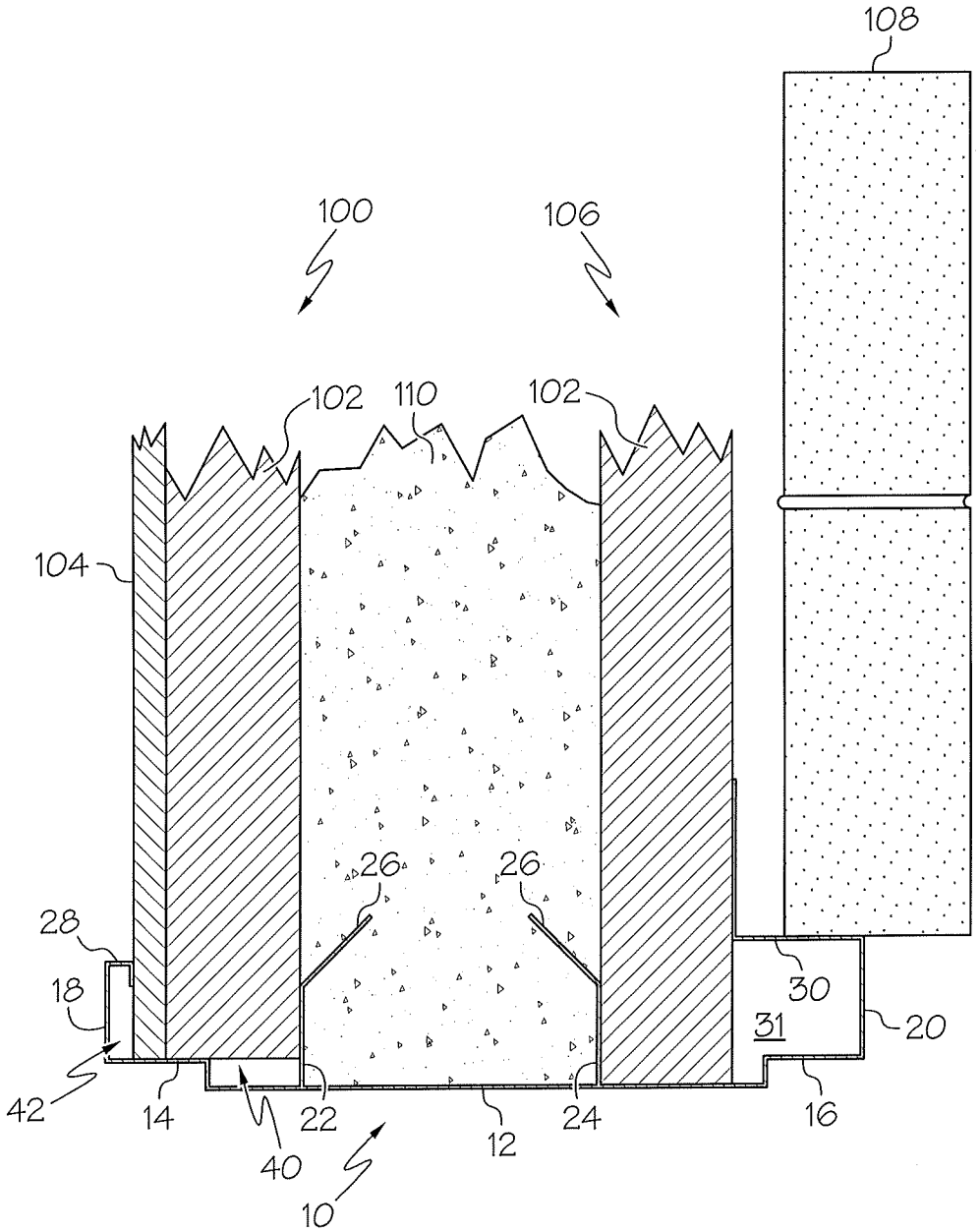
FIG. 2 depicts a cross-sectional view of an exemplary framing member engaged with a wall system.

FIG. 2 shows an alternative configuration for framing member 10. In this variation, inner flanges 22, 24 extend from first member 12. Second member 14 extends outwardly from an end of first member 12; while third member 16 extends outwardly from the other end of first member 12. First outer flange 18 and curling member 28 of this variation are configured similar to the configuration of these components 18, 28 described above with respect to FIG. 1. Second outer flange 20 of this variation is configured similar to the configuration of second outer flange 20 described above with respect to FIG. 1; while curling member 30 of this variation extends away from first member 12 after extending toward second inner member 24. While curling member 28 is configured to engage drywall 104 (or any other interior wall covering), curling member 30 is configured to engage wall member 102 and brick 108 (or any other exterior building façade material). As is also shown, a gap 40 is provided between wall member 102 of first wall portion 100 and first member 12. Another gap 42 is provided between first outer member 18 and drywall 104. It will be appreciated that the orientation angles of anchor portions 26 with respect to inner flanges 22 can enable anchor portions 26 to serve to guide and ease engagement of wall members 102 with framing member 10, or vice versa, during installation of framing member 10. With framing member 10 engaged with first and second wall portions 100, 106, concrete 110 is poured between first and second wall portions 100, 106. As shown, poured concrete 110 abuts first member 12, inner flanges 22, 24, and anchor portions 26. It will be appreciated that inner flanges 22, 24 serve both to help secure wall members 102 in proper position and also to prevent concrete from flowing into gaps or spaces 31, 40 during pouring, which may be desired if these spaces are preferably kept open to facilitate, for example, installation of hardware, wiring, etc. Anchor portions 26 are configured such that framing member 10 will be held securely in place after poured concrete 110 hardens.

Figure 3:
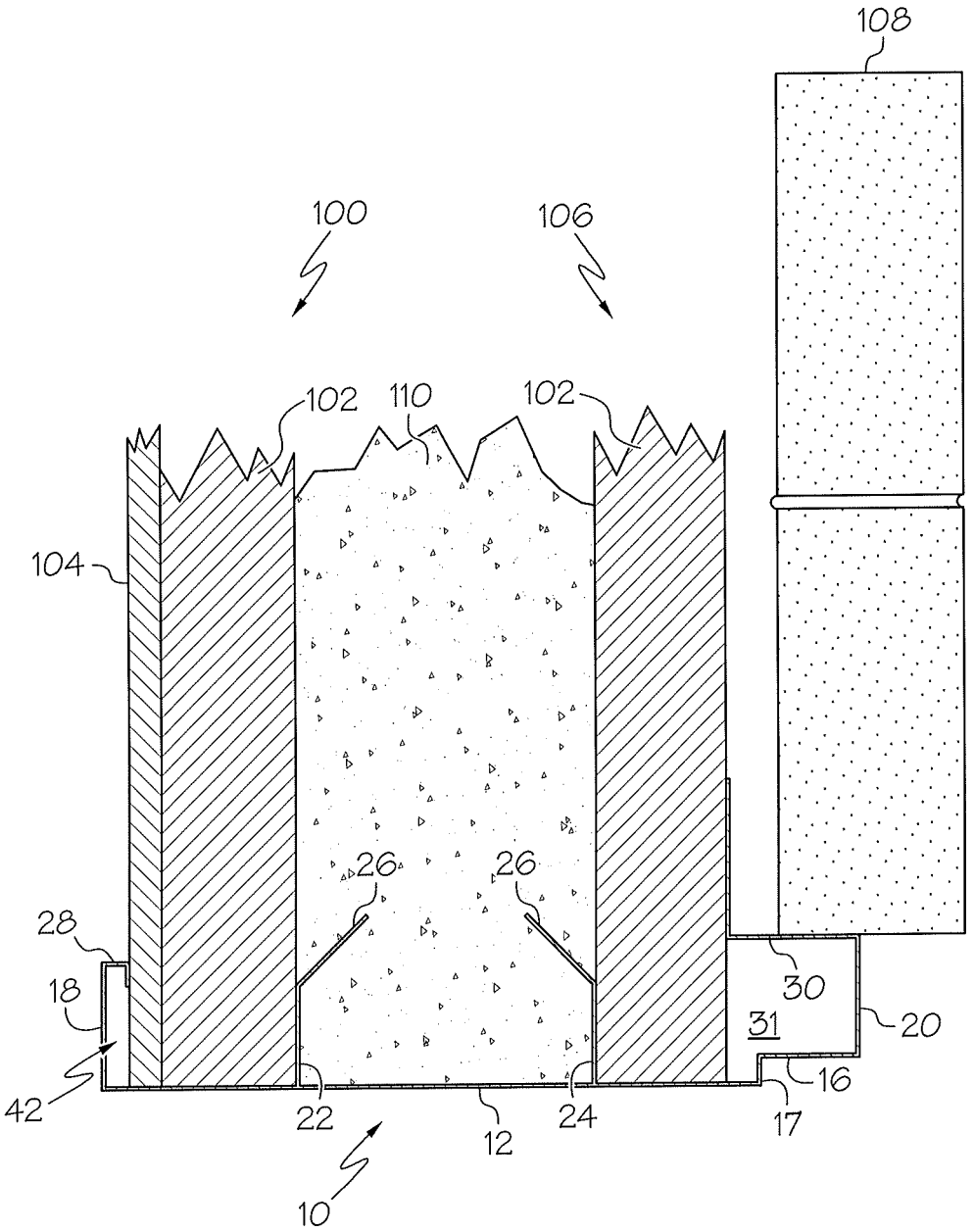
FIG. 3 depicts a cross-sectional view of another exemplary framing member engaged with a wall system.

FIG. 3 shows another alternative configuration for framing member 10. In this variation, second member 14 may be regarded as either eliminated or integral with first member 12. In other words, first outer flange 18 extends directly from first member 12. As shown, this variation eliminates gap 40, such that wall member 102 of first wall portion 100 abuts first member 12. Similarly, drywall 104 abuts first member 12. The configuration shown in FIG. 3 is otherwise similar to the configuration shown in FIG. 2.

Figure 4:
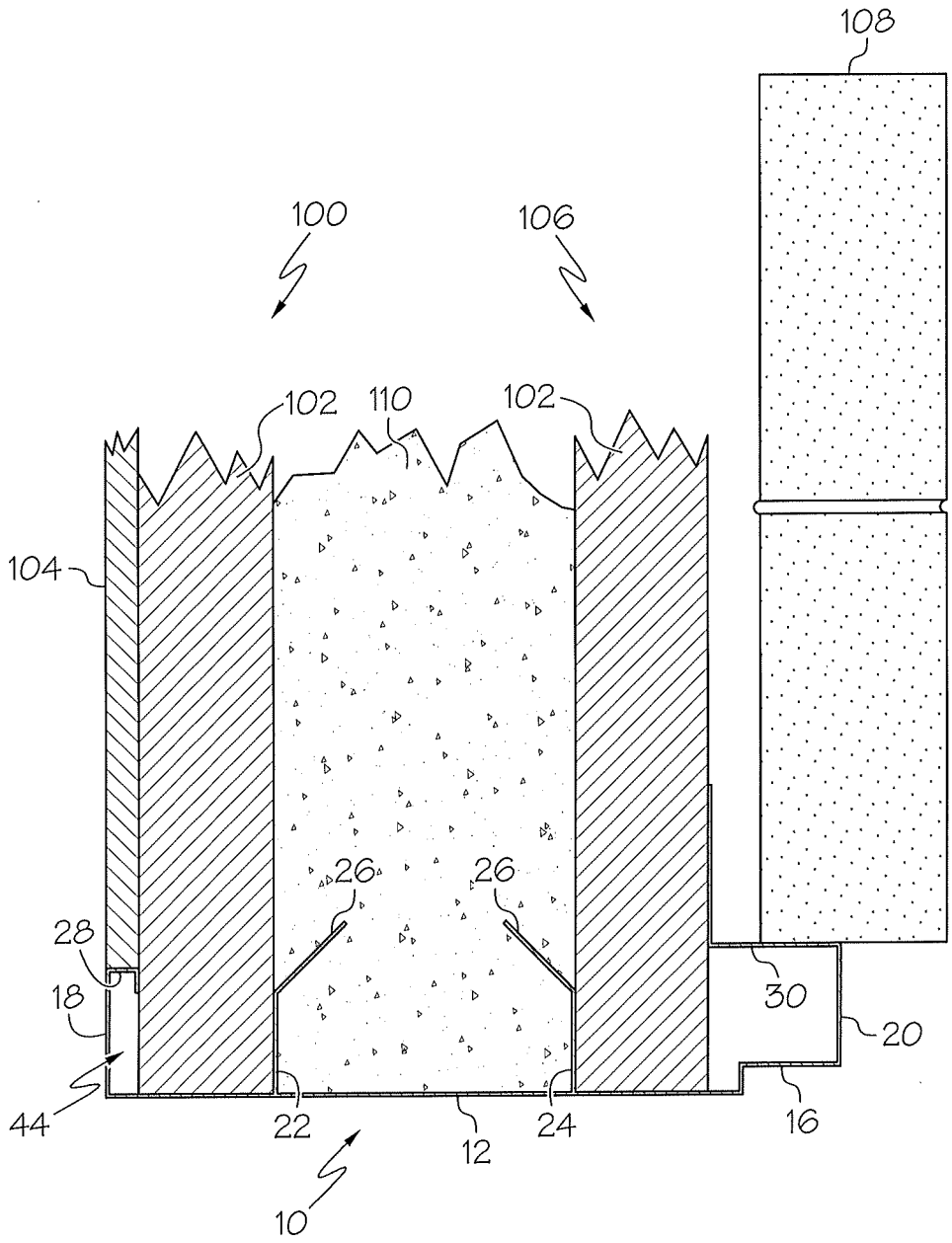
FIG. 4 depicts a cross-sectional view of yet another exemplary framing member engaged with a wall system.

FIG. 4 shows yet another alternative configuration for framing member 10. In this variation, the spacing between first outer flange 18 and first inner flange 22 is reduced relative to the spacing between such components 18, 22 shown in FIG. 3. Due to the reduction in this spacing, curling portion 28 abuts wall member 102 of first wall portion 100, with a gap 44 being provided between first outer flange 18 and wall member 102 of first wall portion 100. Curling portion 28 also abuts drywall 104, but at an end of drywall 104 instead of at the inner surface of drywall 104. Furthermore, curling portion 28 is configured such that, when framing member 10 and wall portions 100, 106 are installed in place, the outer surface of drywall 104 will be substantially flush with first outer flange 18. The configuration shown in FIG. 4 is otherwise similar to the configuration shown in FIG. 3.

The various configurations for framing member 10 shown in FIGS. 1-4 are not intended to be exhaustive. It will therefore be appreciated that components of framing member 10 may be modified in a variety of ways. For instance, various components may be reconfigured, substituted, supplemented, or omitted. Similarly, relationships between such components relative to one another, and relationships between such components and wall portions 100, 106, may be varied in a variety of alternative ways.

Figure 5:
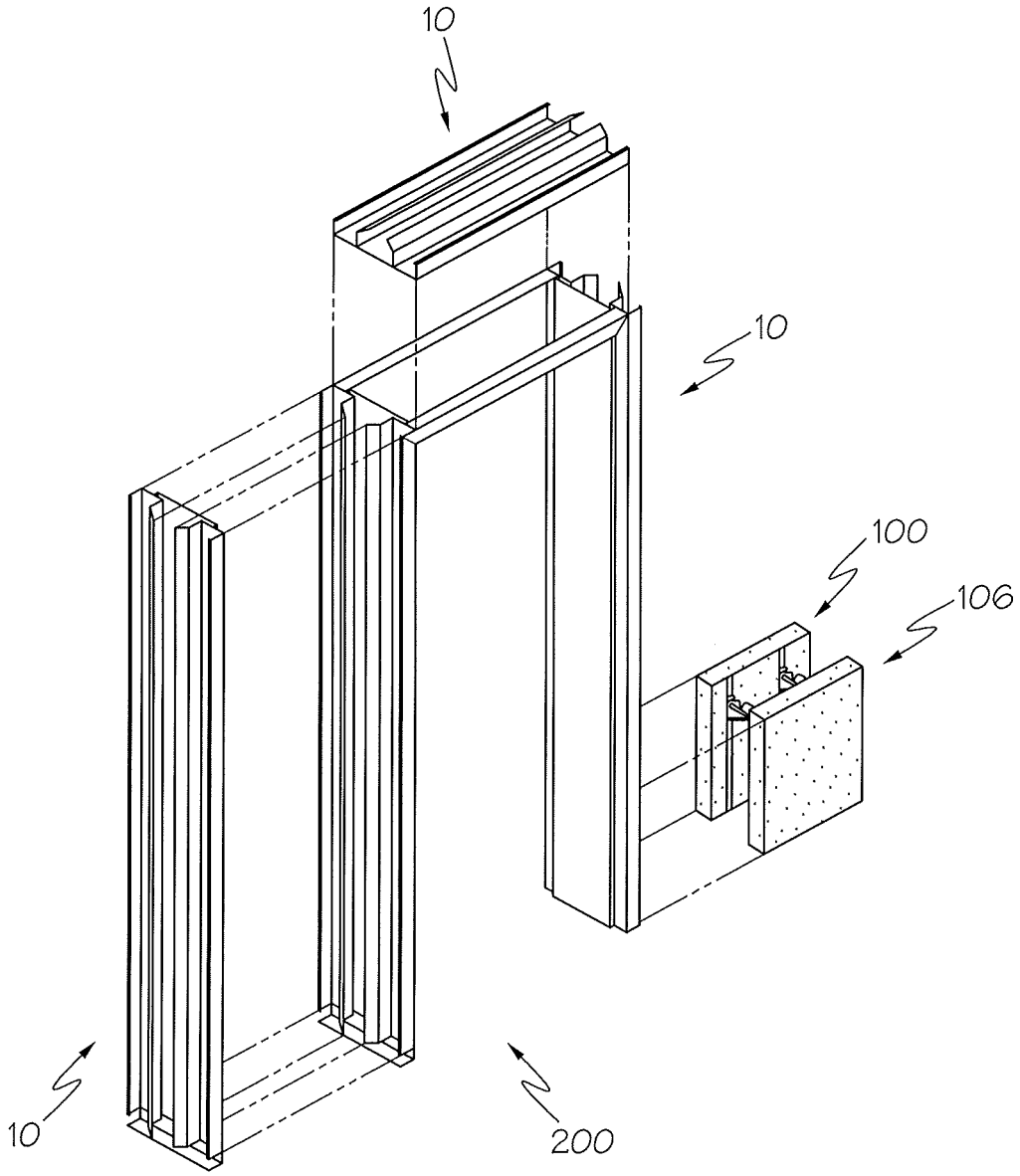
FIG. 5 depicts a perspective view of exemplary framing members forming an exemplary framing system.

FIG. 5 shows an example of how framing members 10 may be joined together to form a door frame 200. In particular, ends of framing members 10 may be joined to define a door frame 200, such as by welding, mechanical fastening, abutment, or using any other suitable technique, materials, or structures. Framing members 10 forming a door frame 200 may be engaged with wall portions 100, 106 in any suitable fashion, including but not limited to such engagement as described above.

Figure 6B:
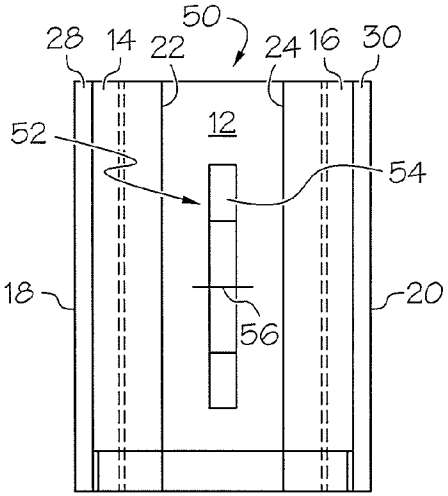
FIG. 6B depicts a plan view of the framing member of FIG. 6A.
Figure 6C:
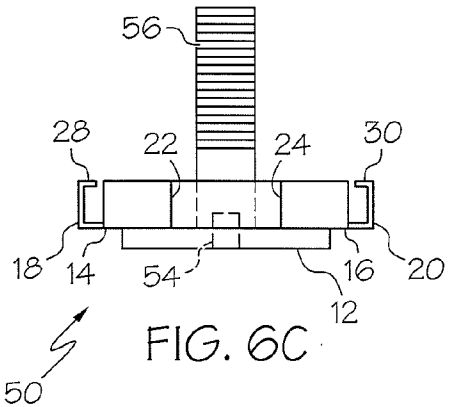
FIG. 6C depicts an end view of the framing member of FIG. 6A.
Figure 6A:
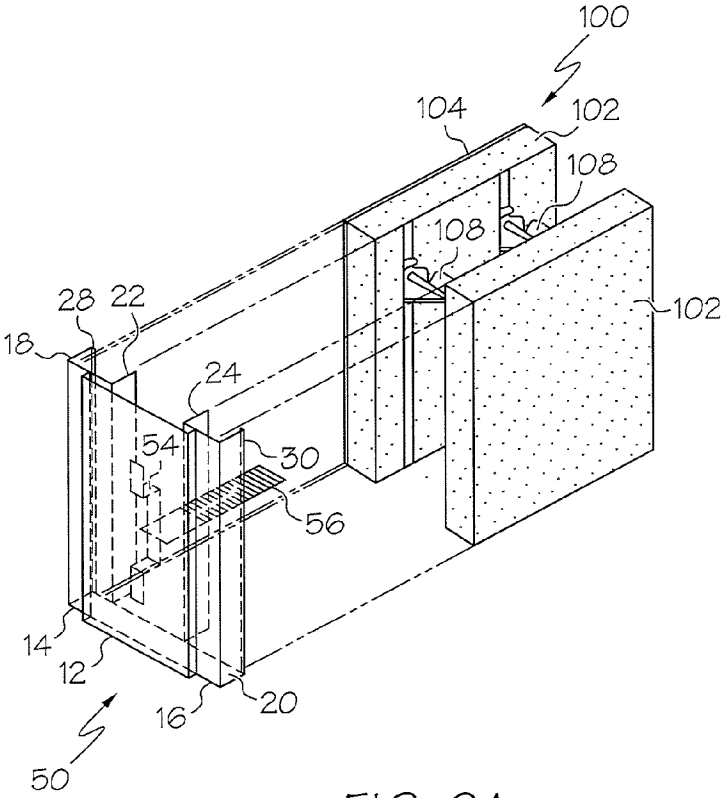
FIG. 6A depicts a perspective view of an alternative framing member.

FIG. 6 shows yet another alternative framing member 50. Framing member 50 of this example is similar to framing member 10 shown in FIG. 1, except that an anchor strap assembly 52 is provided in lieu of anchor members 26. Anchor strap assembly comprises an anchor strap mount 54 secured to first member 12. An anchor strap 56 is secured to anchor strap mount 56 and extends away from first member 12. The other components of framing member 50 are similar to those of framing member 10 shown in FIG. 1. Framing member 50 is also configured to engage wall portions 100, 106 in a manner similar to framing member 10 shown in FIG. 1. When framing member 50 is engaged with wall portions 100, 106, and when concrete 110 is poured between wall portions 100, 106, anchor strap 56 is configured to engage poured concrete 110. Accordingly, anchor strap 56 may secure framing member 50 in place in a manner similar to anchor members 26.

Figure 7:
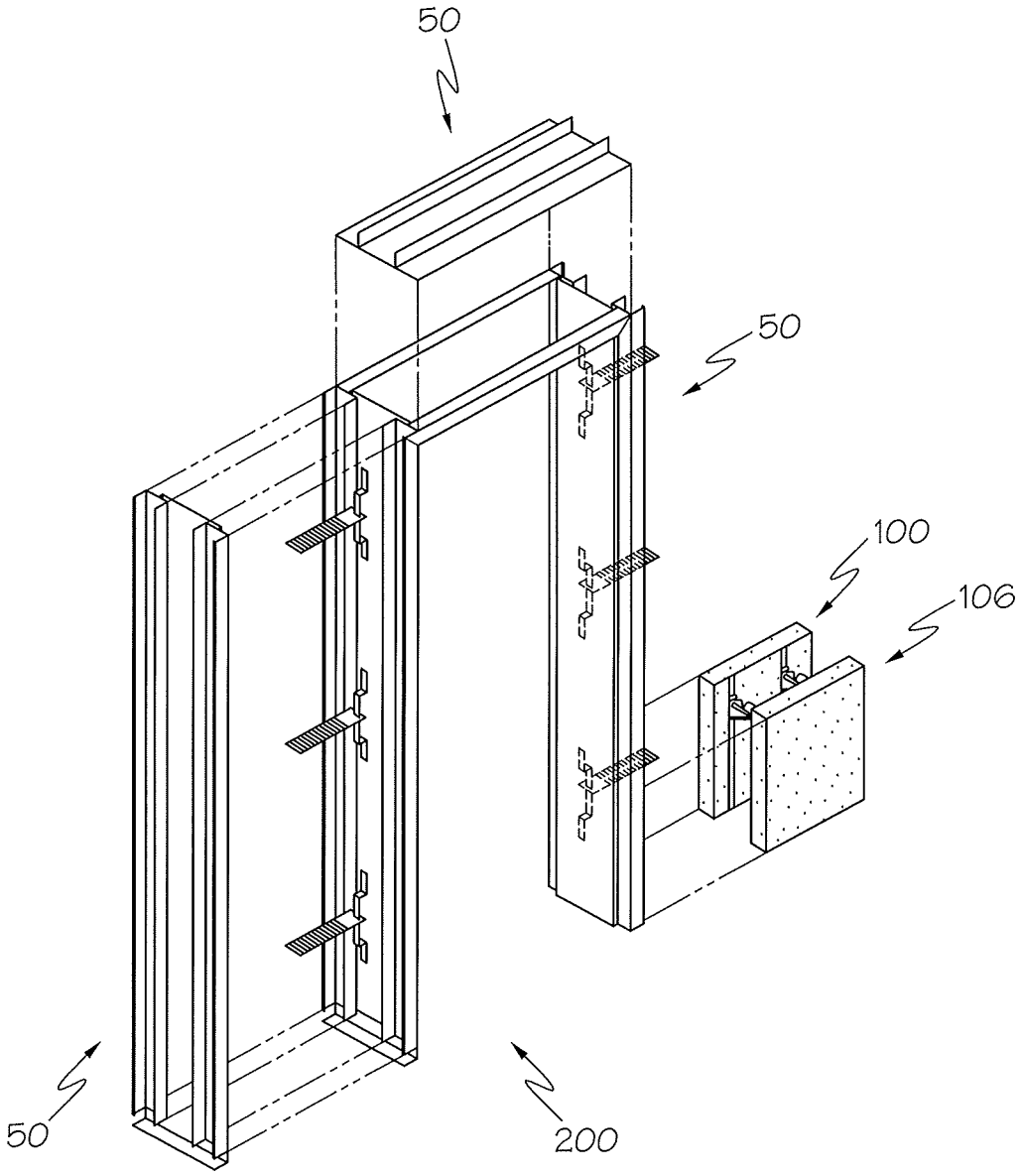
FIG. 7 depicts a perspective view of alternative framing members forming an alternative framing system.

FIG. 7 shows an example of how framing members 50 may be joined together to form a door frame 200. In particular, ends of framing members 50 may be joined to define a door frame 200, such as by welding, mechanical fastening, abutment, or using any other suitable technique, materials, or structures. Framing members 50 forming a door frame 200 may be engaged with wall portions 100, 106 in any suitable fashion, including but not limited to such engagement as described above. As is also shown in FIG. 7, a plurality of anchor strap assemblies 52 may be secured to each first member 12.

Figure 8:
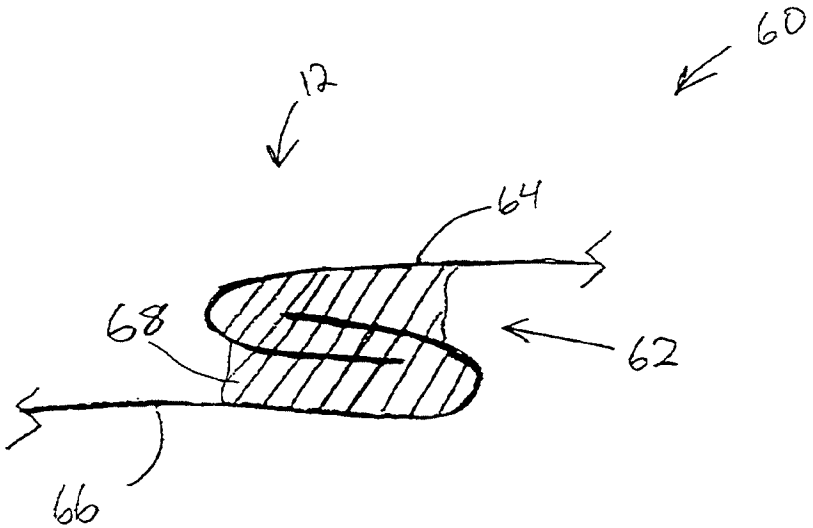
FIG. 8 depicts a partial cross-sectional view of another alternative framing member.

FIG. 8 shows another variation of a framing member 60. In this variation, framing member 60 comprises a thermal break 62 for reducing heat transfer through the framing member 60 when installed, for example, in an exterior wall, in which one portion of framing member 60 will be inside a climate controlled building and the other portion will be outside the building. Framing member 60 may be configured similar to, for example, framing member 10 shown in FIG. 1, except that first member 12 is longitudinally separated into two portions—a first portion 64 and a second portion 66. First portion 64 and second portion 66 each have cooperating joining features, such that the first and second portions 64, 66 may be joined, for example, in an "S"-like configuration as shown. An insulating material 68 is provided between the cooperating joining features of first and second portions 64, 66. Insulating material 68 may comprise any suitable material, including but not limited to a foam, a caulking material, a rubber or plastic, or any other suitable material. Material 68 also may be comprised by a pre-formed, for example, extruded, strip, trim piece or fitting suitably designed to cooperate with the cooperating joining features of first and second portions 64, 66 and effect, facilitate and/or secure the joining thereof. In one embodiment, insulating material 68 has lower thermal conductivity than the material of which first and second portions 64, 66 are formed. Other suitable properties for material 68, and substances of which material 68 may be comprised, will be apparent to those of ordinary skill in the art. It will also be appreciated that first and second portions 64, 66 may be provided in various alternative configurations in lieu of or in addition to the "S"-like configuration shown in FIG. 8, to effect a joining of first and second portions of a framing member and create a thermal break.

Figure 10:
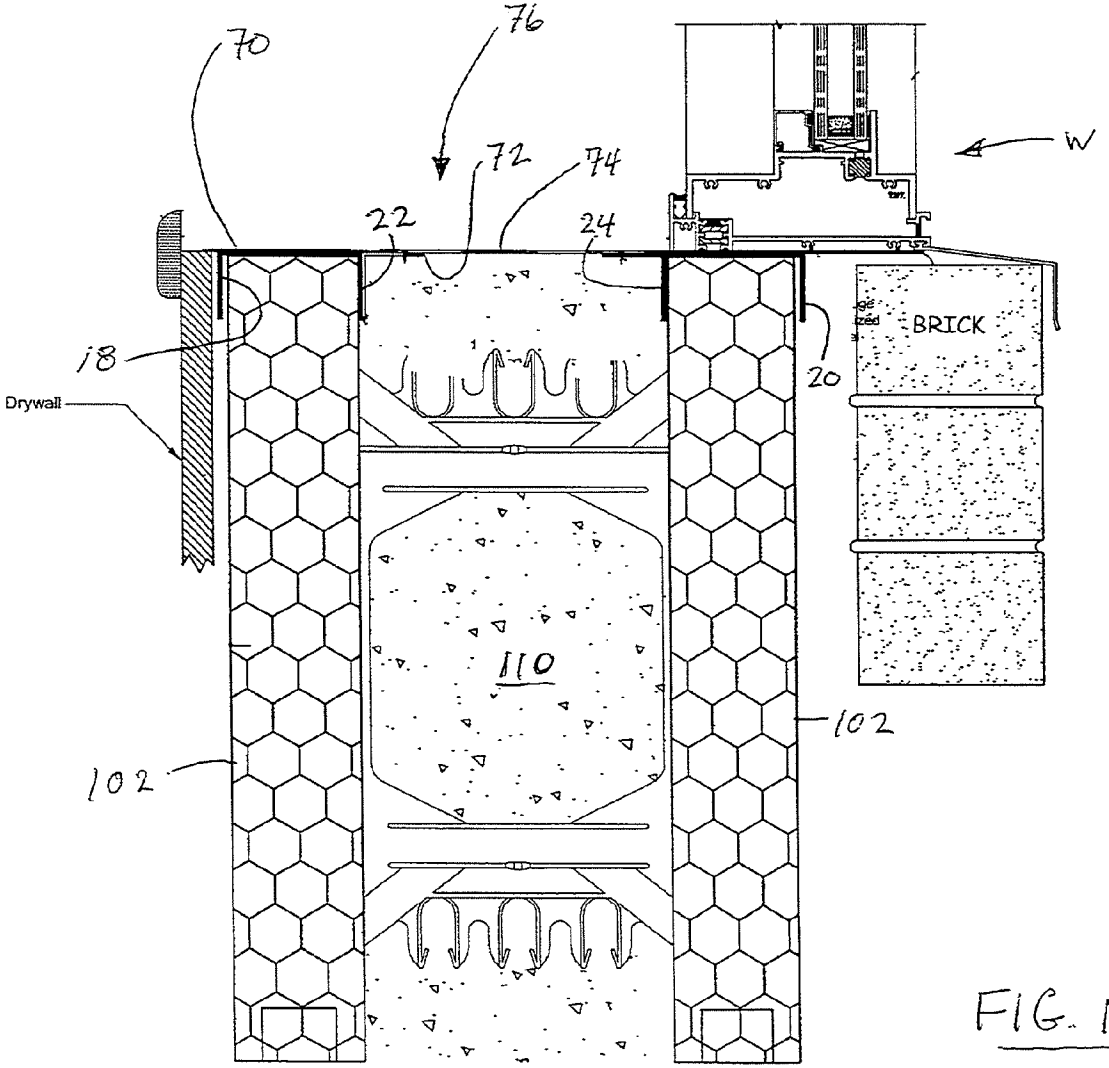
FIG. 10 is a cross-sectional view of another alternative, exemplary framing member used as a sill member in a window opening.
Figure 10A:
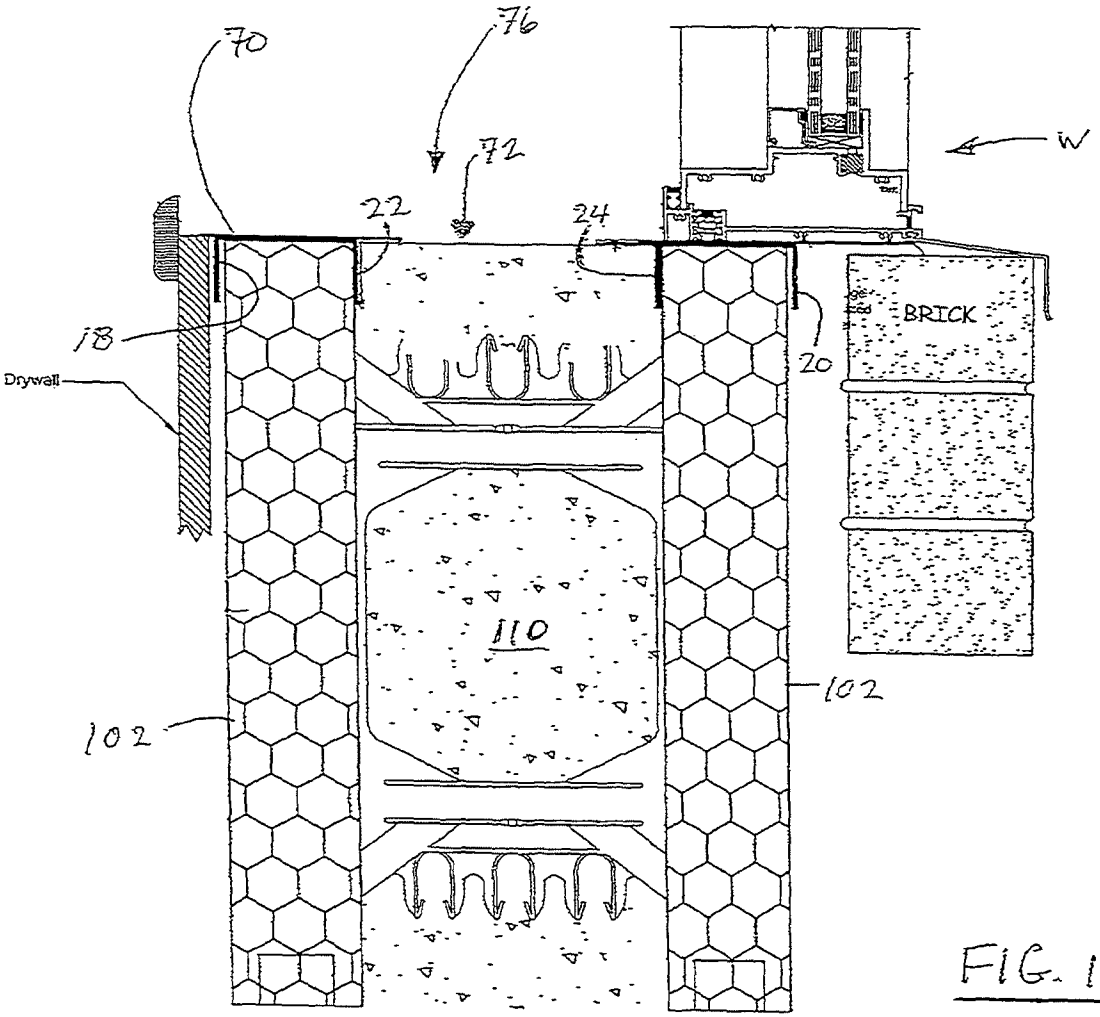
FIG. 10A is a cross-sectional view of the exemplary framing member of FIG. 10 prior to installation of an access plate.
Figure 11:
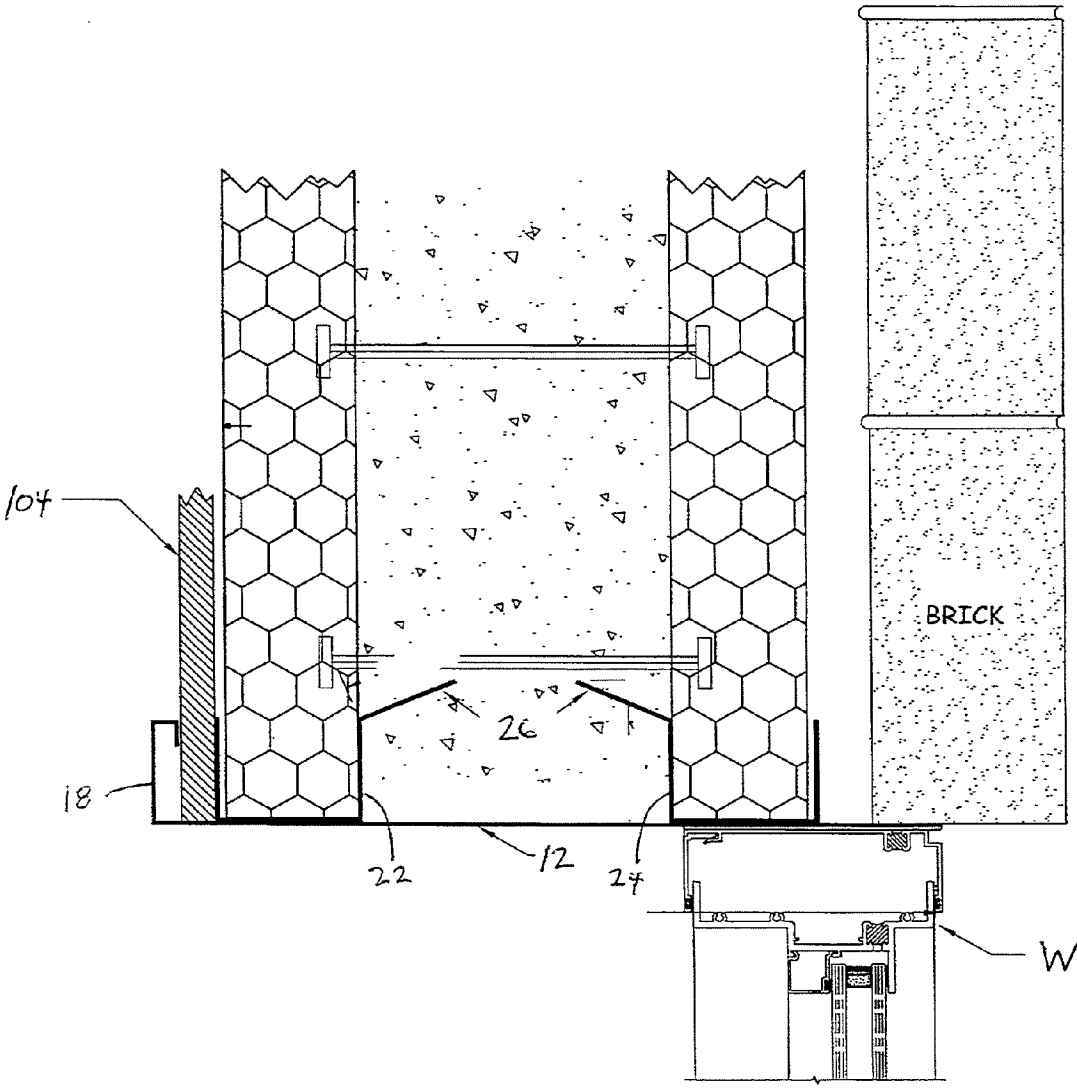
FIG. 11 is a cross-sectional view of another alternative, exemplary framing member used as a jamb member in a window opening.
Figure 12:
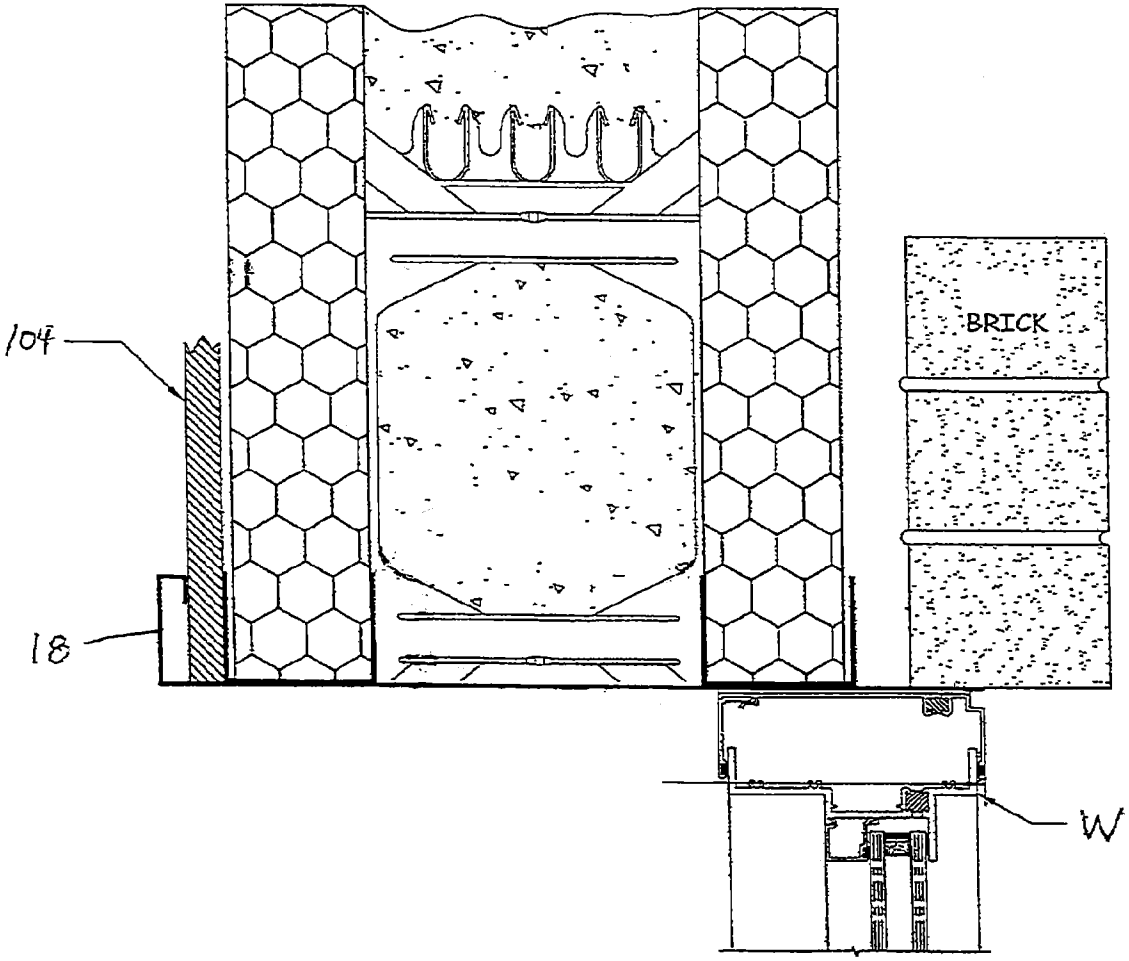
FIG. 12 is a cross-sectional view of another alternative, exemplary framing member used as a header member in a window opening.

FIG. 10 shows a cross section of another variation of a framing member 70 configured to serve as a sill member, and in place atop wall members 102 and poured concrete 110. Framing member 70 has first and second outer flanges 18, 20, and first and second inner flanges 22, 24. As shown, flange pairs 18, 22 and 20, 24, respectively, position and hold respective wall members 102 and framing member 70 in suitable final installation position with respect to each other. Framing member 70 also has sill surface portion 76, on which a window unit W may rest in installed position as shown. Alternatively, framing member 70 may be configured to accept installation of a door threshold (not shown) or any other component, depending upon the purpose of the framed opening. Particularly when a member such as framing member 70 is used as a sill member to frame a large horizontal opening such as, for example, a window or storefront opening over 3 feet wide, it may be desirable to provide a way to pour and/or vibrate concrete 110 beneath surface portion 76, to eliminate the necessity for pouring and/or vibrating concrete before installation of framing member 70, or moving framing member 70, or making one or more access holes in wall members 102. Accordingly, surface portion 76 may have one or more access holes 72 therethrough, of a suitable size and placement along the length of framing member 70 to permit pouring of concrete therethrough, into the space between wall members 102. Additionally or alternatively, one or move access holes such as access hole 72 may be located on framing member 70 and used as access point(s) for insertion and use of a concrete vibrator. Following pouring and/or vibrating of concrete 110 through access hole 70, an access plate 74 may be installed to cover access hole 72, and may be fixed in place on framing member 70 via screws at its edges or any other suitable attachment or fastening means.

Figure 13:
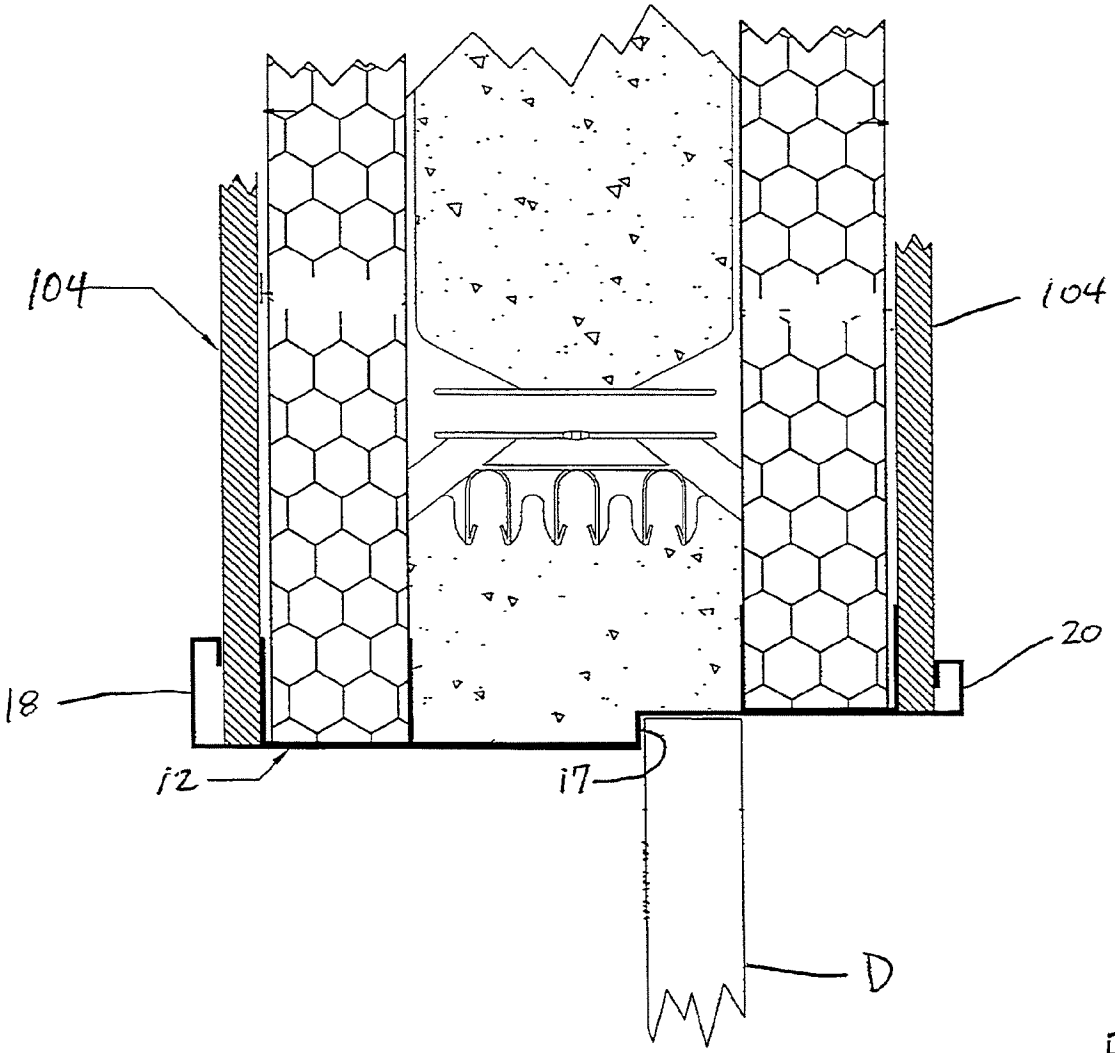
FIG. 13 is a cross-sectional view of another alternative, exemplary framing member used as a header member in a door opening.
Figure 14:
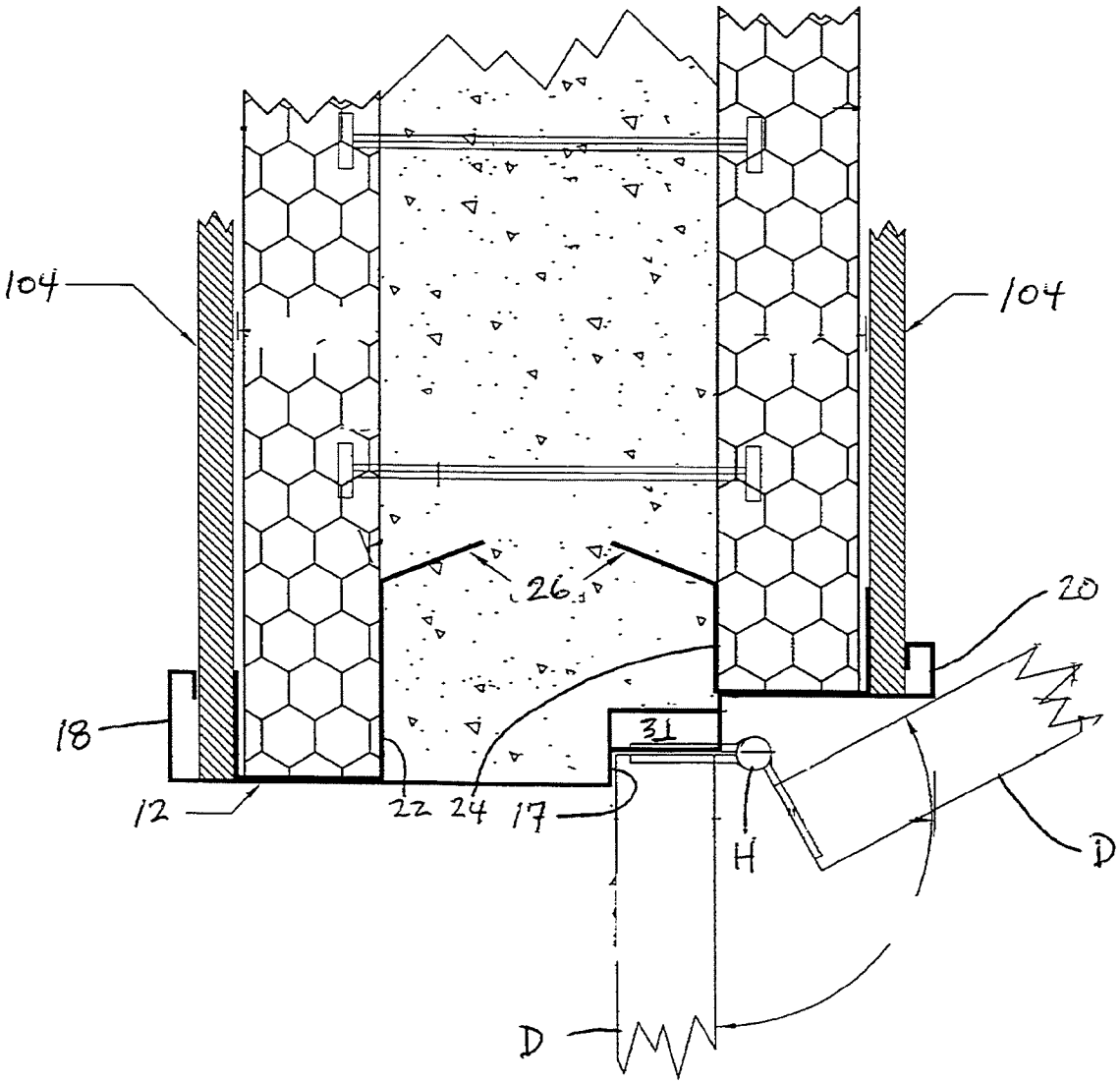
FIG. 14 is a cross-sectional view of another alternative, exemplary framing member used as a jamb member in a door opening.
Figure 15:
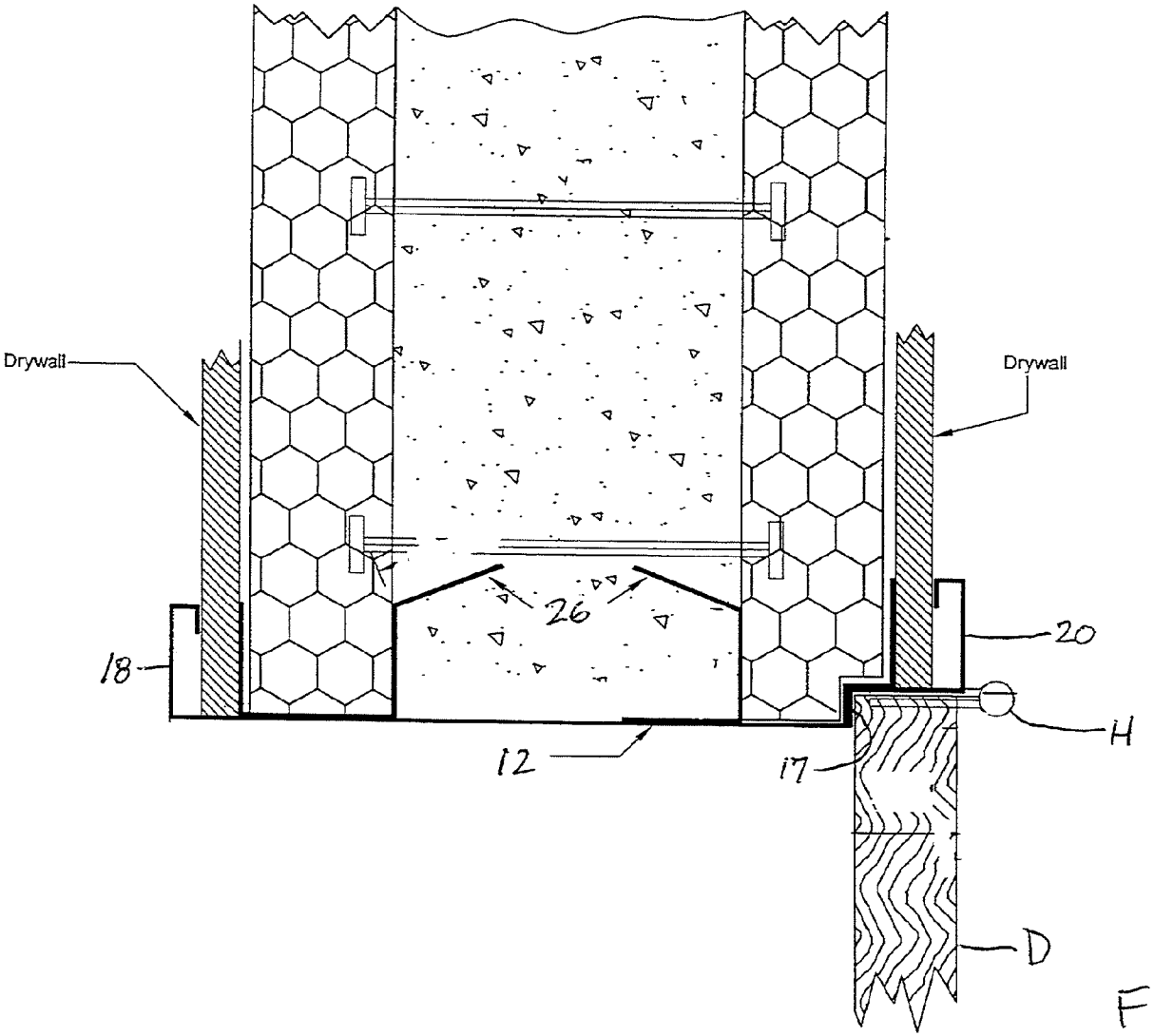
FIG. 15 is a cross-sectional view of another alternative, exemplary framing member used as a jamb member in a door opening.
Figure 16:
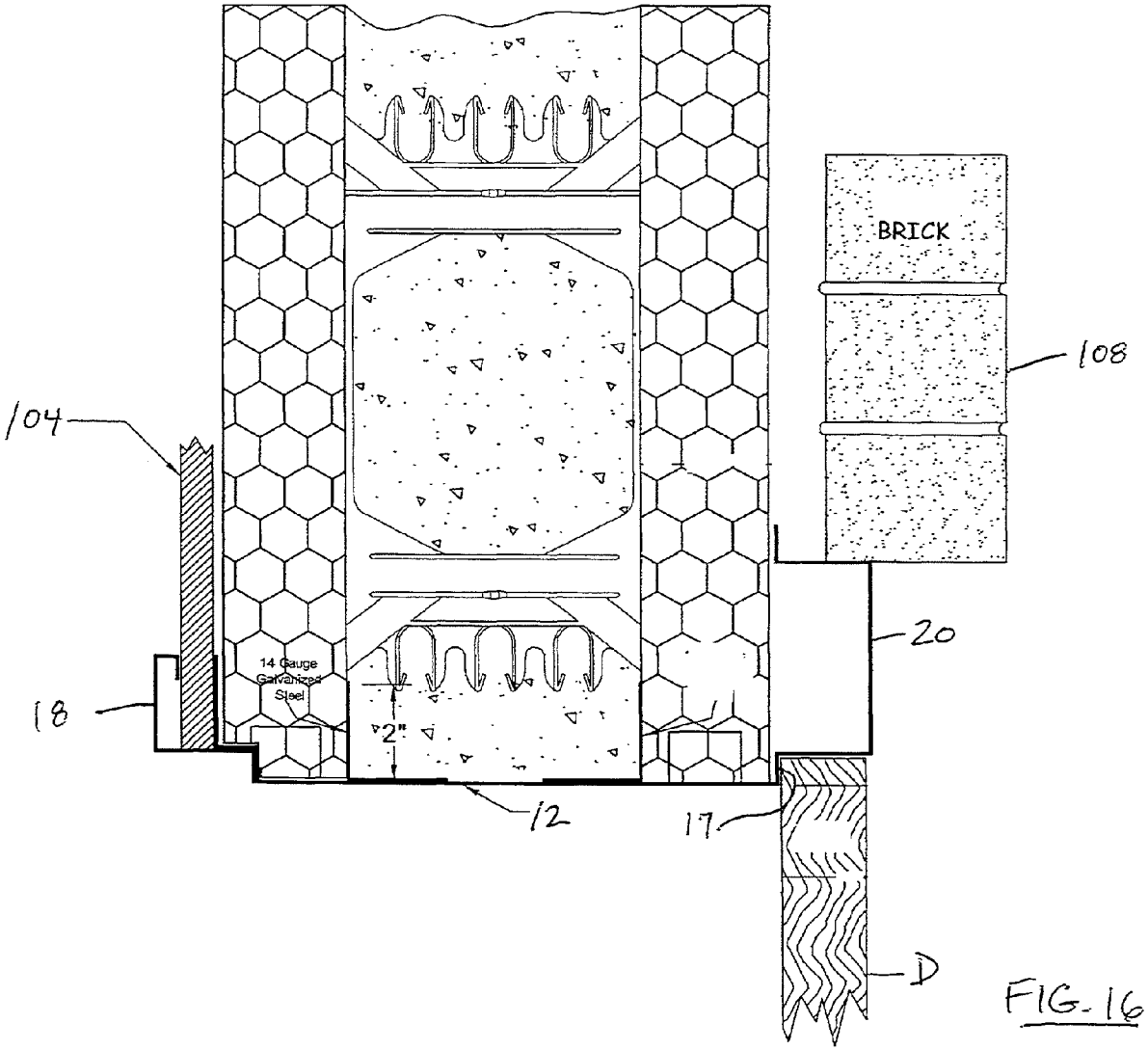
FIG. 16 is a cross-sectional view of another alternative, exemplary framing member used as a header member in a door opening.
Figure 17:
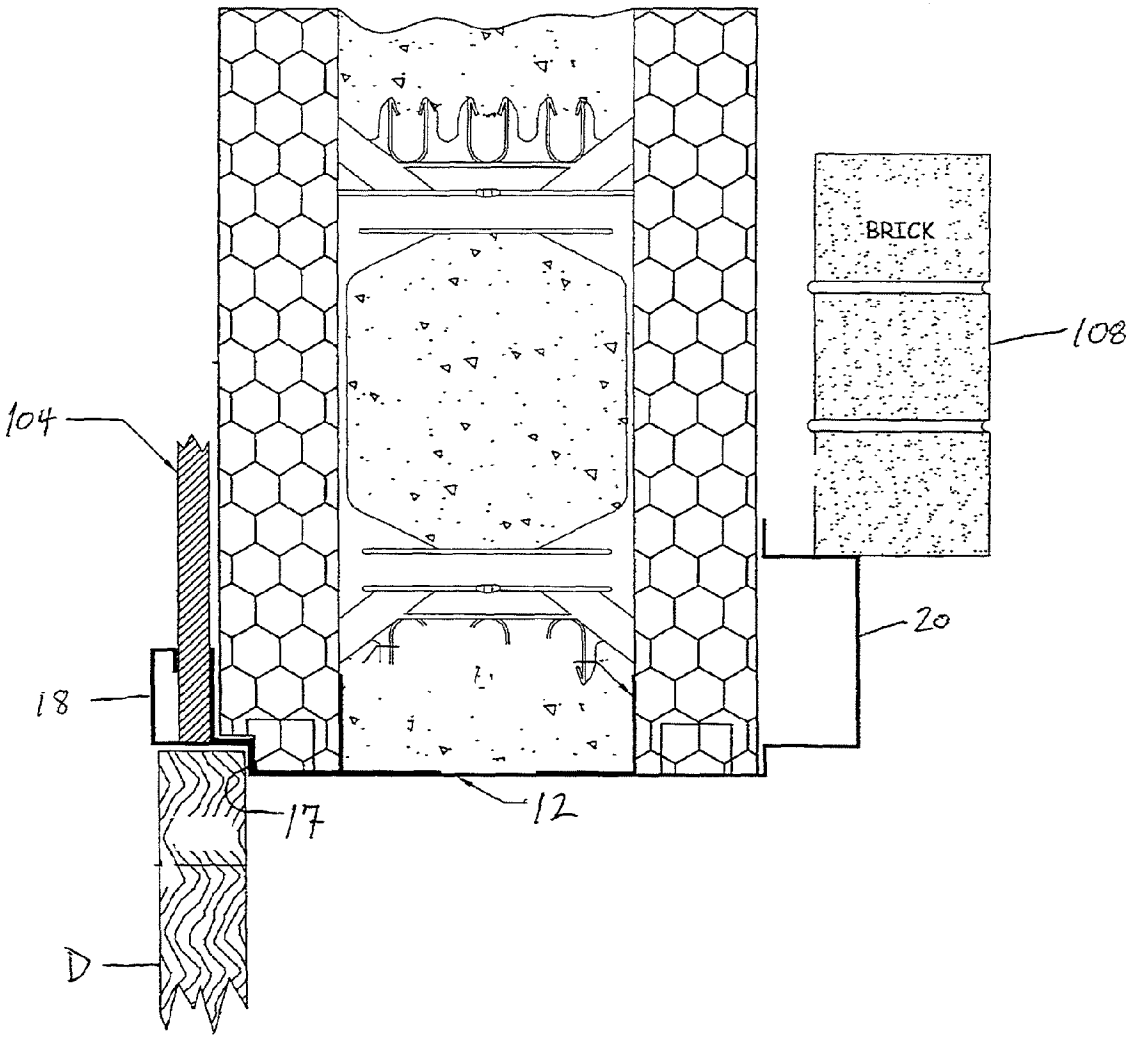
FIG. 17 is a cross-sectional view of another alternative, exemplary framing member used as a header member in a door opening.

Those of ordinary skill in the art will appreciate that framing members 10, 50, 60, 70 described herein may be formed to have the features depicted in the drawings, or other features, to accommodate various purposes. For example, referring to FIG. 3, third member 16 may be formed so as to provide a framed opening and stop surfaces 17 for installation of a door (see, for example, FIGS. 13-17), including accompanying hardware. In the examples shown, door hinges H (see, for example, FIGS. 14, 15) may be affixed to third member 16 by screws (not shown) driven through third member 16 and into the space 31 therebehind. Weather stripping or cushioning members may be installed against stop surfaces 17. It will be appreciated, then, that a door stop member may be incorporated into a framing member at locations other than as shown in, for example, FIG. 3. See, for example, FIGS. 13-17. Similarly, various types of window tracks and other features of window frames may be incorporated into a framing member. Additionally, referring to FIG. 2, it will be appreciated that outer flanges 18, 20 may be incorporated to provide a finished appearance to walls. By way of example in FIG. 2, and also FIGS. 16 and 17 first outer flange 18 is situated so as to cover and provide a finished appearance to drywall 104 installed around the opening, functioning in the manner of casing; and second outer flange 20 is situated so as to abut, provide a caulking surface, and provide a finished frame appearance where the frame meets masonry such as brick work 108, functioning in the manner of brick molding. Alternatively, second outer flange 20 may be configured to engage, conceal edges, and provide a finished appearance when used in conjunction with, for example, siding, stucco or other exterior finishes. Alternatively, both first and second outer flanges 18, 20 may be configured to engage, conceal edges and provide a finished appearance for drywall 104, functioning as casing. See, e.g., FIGS. 13-15. It will be appreciated, thus, that a framing member as described herein may be formed to include members to serve the functional and aesthetic purposes of door stops, window tracks or grooves to accommodate fixed or movable windows, moldings, sills, jambs, casings and the like.

Those of ordinary skill in the art will appreciate that framing members 10, 50, 60, 70 described herein may be formed in a variety of ways. By way of example only, framing members 10, 50, 60, 70 may be formed by cutting and bending sheet or roll stock, by extrusion, or by any other suitable method. Flanges, curling portions, anchor members and any other included members may be formed to be integral with framing members, or may be affixed thereto by welding, adhesives, bonding, mechanical fastening such as screwing or riveting, cooperating joining features or any other suitable method.

Framing members 10, 50, 60, 70 described herein may be formed using a variety of materials. Various metals may be used, for example, steel, stainless steel, aluminum, etc. Alternatively, vinyl, fiberglass, fiberglass reinforced plastic (FRP), other plastics or other materials may be used, including combinations of materials. For instance, in one variation, a steel framing member 10, 50, 60, 70 may be reinforced with fiberglass. Similarly, any suitable process other than extrusion may be used to produce framing members 10, 50, 60, 70.

It will also be appreciated that framing members 10, 50, 60, 70 may be subject to various forms of surface treatment. For instance, if protection from corrosion is required, all or part of a framing member 10, 50, 60, 70 may be coated with paint, primer, rust inhibitor, or other coating(s), including combinations thereof. Framing members 10, 50, 60, 70 may also be pre-finished, painted, varnished, anodized, galvanized, metal-coated, brushed, blasted or subject to any other suitable surface treatment for functional or aesthetic purposes.

An example of a method of constructing a building wall having an opening framed by a framing system of the present invention will now be described. By way of example, and referring to FIGS. 2 and 5, a door frame 200 having, for example, framing members 10 such as member 12 serve as side door jamb members, may be prefabricated to specifications and delivered to the project site. The door frame assembly may then be placed in position as required by the building plans, affixed or anchored at the bottom upon a foundation wall, floor or other base as required, and adjusted to and held in vertical, plumb position by suitable temporary bracing. Thereafter, components of a suitable wall forming system such as wall members 102, having vertical edges, may be moved toward framing member 10, guided into alignment and engagement with inner flanges 22, 24 using the angled guiding surfaces of anchor portions 26. With wall members 102 in position abutting framing member 10, concrete may be poured into the space between wall members 102, and into the respective channels formed by member 12, flanges 22, 24 and anchor portions 26, as shown in FIG. 2. It will be appreciated that when the concrete hardens, framing member 10 will be securely held in place as a result of flanges 22, 24 and anchor portions 26 thereof being encased by the hardened concrete.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of whatever claims recite the invention, and is understood not to be limited to the details of structure and operation shown and described in the description.

What is claimed:

1. A wall assembly comprising:

a wall component comprising a first wall panel comprising a first interior surface, a first exterior surface, and a first edge extending between the first interior surface and the first exterior surface, a second wall panel comprising a second interior surface, and at least one connecting member positioned between the first wall panel and the second wall panel, and an interior cavity between the first wall panel and the second wall panel; and a framing member, wherein the framing member at least partially defines an opening in the wall assembly, the framing member comprising a longitudinal axis, a first panel receiving channel configured to receive at least a portion of the first wall panel, wherein at least a portion of the first wall panel is received within the first panel receiving channel such that at least a portion of the first edge of the first wall panel abuts a portion of the framing member that is oriented substantially perpendicular to the longitudinal axis of the framing member, and a first inner flange, wherein the first inner flange comprises an inner surface, wherein the first interior surface of the first wall panel engages at least a portion of the inner surface of the first inner flange when the first wall panel is received within the first panel receiving channel, wherein the inner surface of the first inner flange extends substantially parallel to the longitudinal axis of the framing member, a first anchor member connected to the first inner flange, wherein the first anchor member is configured to guide the first wall panel into the first panel receiving channel, wherein the first anchor member comprises a fixed end and a free end, a first member comprising a first portion and a second portion, wherein the first inner flange extends substantially perpendicular relative to the first member, wherein the first inner flange is positioned between the first portion of the first member and the second portion of the first member, wherein the first portion of the first member is substantially coplanar with the second portion of the first member, wherein the second portion of the first member comprises an inner surface and an outer surface, wherein the inner surface of the second portion of the first member is exposed to the interior cavity and the outer surface of the second portion of the first member is exposed to the opening in the wall assembly.

2. The wall assembly of claim 1, wherein the framing member further comprises a second panel receiving channel configured to receive at least a portion of the second wall panel, and a second inner flange comprising a second anchor member configured to guide the second wall panel into the second panel receiving channel.

3. The wall assembly of claim 2, wherein the second inner flange comprises a second inner surface, wherein the second interior surface of the second wall panel engages at least a portion of the second inner surface of the second inner flange when the second wall panel is received within the second panel receiving channel.

4. The wall assembly of claim 2, wherein the first anchor member extends toward the second anchor member.

5. The wall assembly of claim 1, wherein the framing member comprises steel.

6. The wall assembly of claim 1, wherein the wall component comprises an insulated concrete form.

7. The wall assembly of claim 1, wherein the framing member further comprises an outer flange, wherein the outer flange defines an outermost edge of the framing member.

8. The wall assembly of claim 7, wherein the wall component further comprises a sheet of drywall positioned adjacent to a first exterior surface of the first wall panel, wherein at least a portion of the sheet of drywall is received between a first exterior surface of the first wall panel and the outer flange.

9. The wall assembly of claim 7, wherein the outer flange further comprises an inwardly curling portion, wherein the wall component further comprises a sheet of drywall positioned adjacent to a first exterior surface of the first wall panel, wherein an edge of the sheet of drywall abuts the inwardly curling portion of the first outer flange.

10. The wall assembly of claim 7, wherein the framing member further comprises a first member, wherein the first inner flange, second inner flange, and outer flange are each integral with the first member.

11. The wall assembly of claim 7, wherein the outer flange comprises an inwardly curling portion configured to engage the second wall panel.

12. The wall assembly of claim 11, wherein the inwardly curling portion is further configured to engage an exterior building facade material.

13. A wall assembly comprising:

a wall component comprising a first wall panel comprising a first interior surface, a second wall panel comprising a second interior surface, and at least one connecting member positioned in a cavity between the first wall panel and the second wall panel;

a quantity of concrete poured into the cavity between the first wall panel and the second wall panel; and a framing member, wherein the framing member at least partially defines an opening in the wall assembly, the framing member comprising a longitudinal axis, a first panel receiving channel configured to receive at least a portion of the first wall panel, wherein the first panel receiving channel comprises a base, a first inner flange comprising a first anchor member configured to guide the first wall panel into the first panel receiving channel, wherein the first anchor member engages the quantity of concrete, wherein a portion of the quantity of concrete substantially surrounds the first anchor member, wherein the first inner flange further comprises an inner surface, wherein the first interior surface of the first wall panel engages at least a portion of the inner surface of the first inner flange, wherein the inner surface of the first inner flange extends substantially parallel to the longitudinal axis of the framing member, a second inner flange, and a first member, wherein the first inner flange extends substantially perpendicular relative to the first member, wherein the first member extends between the first inner flange and the second inner flange, wherein at least a portion of the first member is coplanar with at least a portion of the base of the first panel receiving channel, wherein the first member comprises an inner surface and an outer surface, wherein at least a portion of the inner surface of the first member is exposed to the cavity between the first wall panel and the second wall panel and at least a portion of the outer surface of the first member is exposed to the opening in the wall assembly.

14. The wall assembly of claim 13, wherein the framing member further comprises a second panel receiving channel configured to receive at least a portion of the second wall panel, wherein the second inner flange comprises a second anchor member configured to guide the second wall panel into the second panel receiving channel, wherein the second anchor member engages the quantity of concrete.

15. A wall assembly comprising:

a wall component comprising a first wall panel comprising a first interior surface, a first exterior surface, and a first edge extending between the first interior surface and the first exterior surface a second wall panel comprising a second interior surface, at least one connecting member positioned between the first wall panel and the second wall panel, an interior cavity between the first wall panel and the second wall panel, and a sheet of drywall positioned adjacent to the first exterior surface of the first wall panel; and a framing member, wherein the framing member at least partially defines an opening in the wall assembly, wherein the framing member comprises a longitudinal axis, a first panel receiving channel configured to receive at least a portion of the first wall panel, wherein the first panel receiving channel comprises a base, wherein at least a portion of the first wall panel is received within the first panel receiving channel such that at least a portion of the first edge of the first wall panel abuts a portion of the framing member that is oriented substantially perpendicular to the longitudinal axis of the framing member, a first inner flange, wherein the first inner flange comprises an inner surface that extends substantially parallel to the longitudinal axis of the framing member, a first outer flange, wherein the first inner flange and the first outer flange are spaced to receive at least a portion of the first wall panel and at least a portion of the sheet of drywall between the first inner flange and the first outer flange, a second inner flange, and a first member, wherein the first inner flange extends substantially perpendicular relative to the first member, wherein the first member extends between the first inner flange and the second inner flange, wherein the first member is coplanar with the base of the first panel receiving channel, wherein the first member comprises an inner surface and an outer surface, wherein the inner surface of the first member is exposed to the interior cavity and the outer surface of the first member is exposed to the opening in the wall assembly.

16. The wall assembly of claim 15, wherein the first inner flange comprises a first anchor member configured to guide the first wall panel between the first inner flange and the first outer flange.

17. The wall assembly of claim 15, wherein the framing member further comprises a second outer flange, wherein the second inner flange and the second outer flange are spaced to receive at least a portion of the second wall panel.

18. The wall assembly of claim 17, wherein the second inner flange comprises a second anchor member configured to guide the second wall panel between the second inner flange and the second outer flange.

19. A wall assembly comprising:

a wall component comprising a first wall panel comprising a first interior surface, a first exterior surface, and a first edge extending between the first interior surface and the first exterior surface, a second wall panel comprising a second interior surface, at least one connecting member positioned between the first wall panel and the second wall panel, and an interior cavity between the first wall panel and the second wall panel; and a framing member, wherein the framing member at least partially defines an opening in the wall assembly, the framing member comprising a longitudinal axis, a first panel receiving channel configured to receive at least a portion of the first wall panel, wherein at least a portion of the first wall panel is received within the first panel receiving channel such that at least a portion of the first edge of the first wall panel abuts a portion of the framing member that is oriented substantially perpendicular to the longitudinal axis of the framing member, and a first inner flange, wherein the first inner flange comprises an inner surface, wherein the first interior surface of the first wall panel engages at least a portion of the inner surface of the first inner flange, wherein the inner surface of the first inner flange extends substantially parallel to the longitudinal axis of the framing member, a first anchor member connected to the first inner flange, wherein the first anchor member comprises a free end and a fixed end, a second inner flange, a second anchor member connected to the second inner flange, wherein the first anchor member extends toward the second anchor member, a first member comprising a first portion and a second portion, wherein the first inner flange extends substantially perpendicular relative to the first member, wherein the first portion of the first member defines at least a portion of a base of the first panel receiving channel, wherein the second portion of the first member extends between the first inner flange and the second inner flange, wherein the first portion of the first member is substantially coplanar with at least a portion of the second portion of the first member, wherein the second portion of the first member comprises an inner surface and an outer surface, wherein at least a portion of the inner surface of the second portion of the first member is exposed to the interior cavity and at least a portion of the outer surface of the second portion of the first member is exposed to the opening in the wall assembly.

* * * * *